US005395157A

United States Patent [19]

Rollo et al.

[11] Patent Number: 5,395,157

[45] Date of Patent: Mar. 7, 1995

[54] ROTATABLE SUNTANNING CHAIR WITH INSULATED BASE

[76] Inventors: Linda Rollo, 14-60 164th St., Beechurst; Elvis Cvecic, 144-15 20th Ave., Whitestone, both of N.Y. 11357

[21] Appl. No.: 164,758

[22] Filed: Dec. 10, 1993

[51] Int. Cl.[6] ..... A47L 1/02

[52] U.S. Cl. ..... 297/344.26; 297/188.11; 297/188.14; 297/184.17; 297/183; 297/344.22; 297/423.26; 297/354.13

[58] Field of Search ..... 297/344.21, 344.26, 297/184.17, 184.15, 192, 188, 194, 423.3, 423.26, 354.13, 183, 344.22, 452.63, 188.01, 188.08, 188.11, 188.14

[56] References Cited

U.S. PATENT DOCUMENTS

| | | | |
|---|---|---|---|
| 4,093,305 | 6/1978 | Staroste et al. | 297/184.17 |
| 4,140,128 | 2/1979 | Van Der Schaaf . | |
| 4,379,588 | 4/1983 | Speice | 297/217 |
| 4,474,407 | 10/1984 | Nazar | 297/192 |
| 4,544,202 | 10/1985 | Keaton . | |
| 4,650,245 | 3/1987 | Nazar | 297/192 |
| 4,652,048 | 3/1987 | Nazar | 297/192 |
| 4,824,170 | 4/1989 | Goldmeier . | |
| 4,969,685 | 11/1990 | Chihaya et al. . | |
| 5,004,296 | 4/1991 | Ziegenfuss, Jr. | 297/194 |
| 5,046,782 | 9/1991 | Lundeen . | |
| 5,078,451 | 1/1992 | Sobel | 297/344.26 |
| 5,100,198 | 3/1992 | Baltzell | 297/192 |
| 5,110,184 | 5/1992 | Stein et al. | 297/344.26 |

*Primary Examiner*—Kenneth J. Dorner
*Assistant Examiner*—Milton Nelsen, Jr.
*Attorney, Agent, or Firm*—James & Franklin; Harold James; Robert L. Epstein

[57] ABSTRACT

The articulated body support includes a lower body section, a seat section and an upper body section with a head support portion. The seat section includes a frame with a circular ball bearing track. The track is mounted on top of a box-like base and allows the support to rotate relative to the base about a center pin. The base has a hollow heat insulated enclosure with an access drawer, a magazine receiving recess and a shoulder strap. The upper body section carries an accordion-like collapsible sun shield.

18 Claims, 4 Drawing Sheets

ROTATABLE SUNTANNING CHAIR WITH INSULATED BASE

BACKGROUND OF THE INVENTION

The present invention relates to outdoor lounge chairs and more particularly to an outdoor lounge chair with an articulated body support which is freely rotatably mounted on a stable base which includes a heat insulated enclosure.

Many people in our society consider it of great importance to achieve the darkest, most even suntan possible. To achieve this naturally requires exposure to the sun over a prolonged period of time. This is most comfortably done while sitting or lying in a chair. During the suntanning period, the sun moves, requiring the person to periodically get up and reposition the chair if it is desired to continually confront the sun directly and therefore maximize the effect of the sun rays.

DESCRIPTION OF THE PRIOR ART

In order to eliminate the necessity for periodically getting up and repositioning the chair, we have incorporated a swivel mechanism into our chair which permits the body support of the chair to rotate freely so that it can be moved with the sun, to maintain the desired position. We have also incorporated a heat insulated hollow enclosure into the box-like base to keep beverages cool. The base is equipped with a shoulder strap to facilitate transport of the chair. The head support portion is provided with a collapsible shield to protect the head from the sun, when necessary.

Others have proposed rotatable suntanning chairs or lounges. For example, U.S. Pat. No. 4,379,588 to Speice, U.S. Pat. No. 4,544,202 to Keaton, U.S. Pat. No. 4,824,170 to Goldmeier, U.S. Pat. No. 5,110,184 to Stein et al. and U.S. Pat. No. 5,046,782 to Lundeen all teach rotatable chairs. In the case of Speice, solar cells are used to provide power for a motorized swivel mechanism. However, none of these rotatable chairs have a box-like heat insulated hollow base which provides maximum stability and, at the same time includes cooler storage capacity. Moreover, none provide these features without adding substantial weight to the chair, an important factor in portability.

We are aware of U.S. Pat. No. 5,100,198 to Baltzell which teaches a seat cooler cabinet with an "L" shaped cushion seat plate upon which one can sit when fishing. However, the Baltzell chair is not made for suntanning, it is uncomfortable and has no rotation capability. Moreover, it is so cumbersome and so heavy that it requires retractable wheels for movement.

We are also aware of U.S. Pat. Nos. 4,474,407, 4,650,245 and 4,652,048 all to Nazar which relate to portable chairs with an insulated seat cooler. Nazar's chairs, however, do not support the whole body, they are not rotatable and they do not utilize a stable, box-like base.

Our invention overcomes the disadvantages of each of the above noted chairs. It also incorporates several unique features such as a convenient shoulder strap to facilitate transport, a magazine storage pouch, drink holders and a collapsible sun shield.

It is, therefore, a prior object of the present invention to provide a suntanning lounge chair with rotation capability which is light weight and portable, but at the same time extremely comfortable and very stable.

It is another object to provide a rotatable suntanning chair with a box-like heat insulated base for maximum stability and cooler storage capacity.

It is another object of the present invention to provide a rotatable suntanning chair which includes a ball bearing swivel mechanism with a circular track which provides free rotation.

It is another object of the present invention to provide a suntanning chair with a collapsible sun shield.

It is still another object of the present invention to provide a rotatable suntanning chair which is made up of a relatively small number of simple, inexpensive parts which function reliably together to provide a portable, comfortable and stable lounge chair.

SUMMARY OF THE INVENTION

In accordance with our invention, a rotatable lounge chair is provided comprising a base and an articulated body support including a lower body section, a seat section and an upper section. Means are provided for rotatably mounting the seat section of the body support on the base. The base includes a box-like, heat insulated hollow enclosure having a top surface. The rotatable mounting means includes circular ball bearing track means and a center guide pin operably interposed between the top surface of the enclosure and the seat section of the body support. The body support can freely rotate relative to the base, about an axis defined by the center pin.

The base enclosure includes an access drawer and a magazine storage recess. It also includes a shoulder strap to facilitate transport of the chair.

The seat section includes a substantially rectangular frame. The seat frame includes arm rests. One or both of the arm rests include beverage cup holder recesses.

The mounting means includes a plate supporting the seat frame. The track means comprise a lower track section and an upper track section. The lower track section is mounted on the enclosure top surface. An upper track section is situated in the plate. A center pin receiving means is provided in the plate.

The seat section includes a frame with ratchet hinge means provided for connecting the lower body section to the seat section frame to permit the lower body section to pivot between a position substantially in the plane of the seat section and a position where the free end of the lower body section is substantially in the plane of the bottom enclosure surface.

The upper body section has a head support portion. The head support portion includes means for shielding the head support portion from the sun. The shielding means includes an accordion-like collapsible hood. The hood includes a sheet of flexible material and a plurality of relatively rigid, substantially "U" shaped ribs which support the sheet material. Means are provided for pivotally mounting the ends of the ribs on the upper body section such that the hood is moveable relative to the head support portion between a collapsed position and an expanded position.

BRIEF DESCRIPTION OF THE DRAWINGS

In accordance with the above, and to such other objects which may hereinafter appear, the present invention relates to a rotatable suntanning chair with an insulated base, as set forth in the following specification and recited in the annexed claims, taken together with the accompanying drawings, wherein like numerals refer to like parts and in which:

DESCRIPTION OF THE PREFERRED EMBODIMENT

Figure 1:
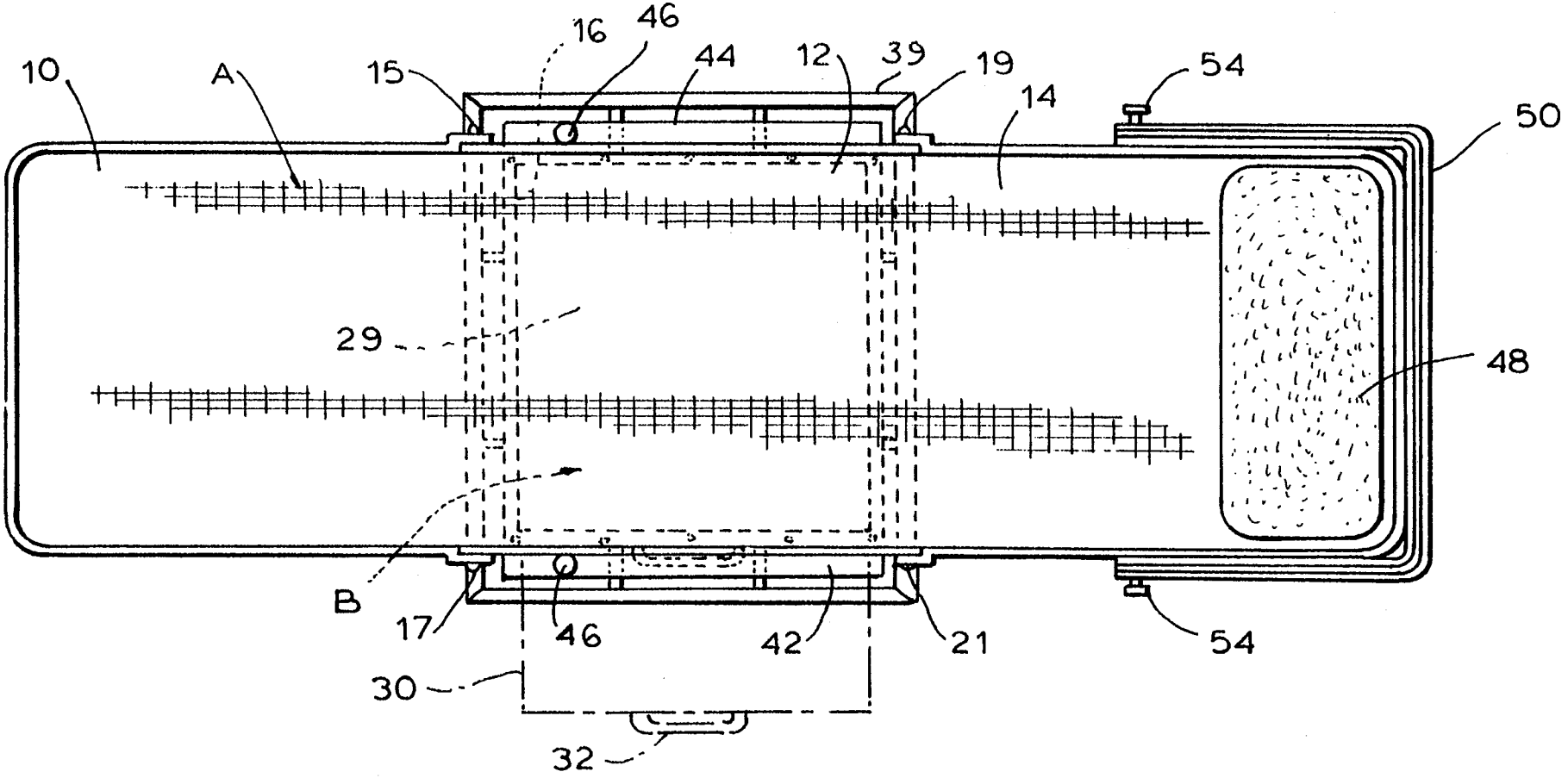
FIG. 1 is a top plan view of our chair.

As seen in the drawings, the lounge chair of the present invention includes a body support, generally designated A, mounted on a box-like base, generally designated B, by means of a ball bearing rotation mechanism, generally designated C. Base B provides a stable yet light weight foundation for body support A as it is rotated to permit the user to maintain the optimum suntanning position.

Body support A consists of three articulated sections 10, 12, 14 which are joined by hinges to permit each of the sections 10 and 14 to independently pivot relative to section 12. Each section comprises a sheet or web of fabric or plastic material situated on and around a light weight frame. Section 10 is provided to support the legs and lower body of the user. Seat section 12 supports the middle of the body. Section 14 supports the upper body and head.

Figure 3:
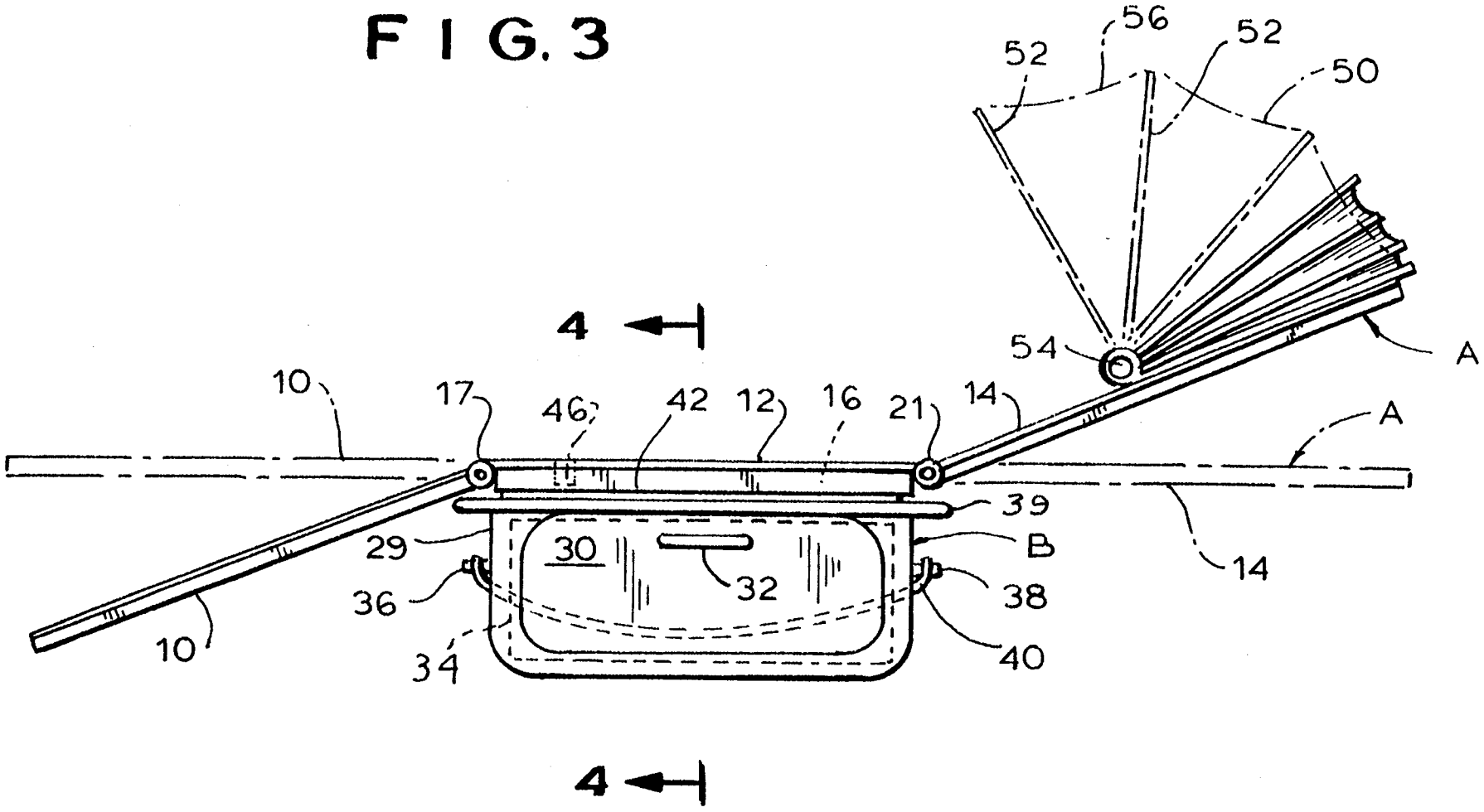
FIG. 3 is a side view of our chair.

Seat section 12 is supported on a seat frame 16. Section 10 and section 14 are pivotally connected to opposite sides of frame 16 by hinge sets 15, 17 and 19, 21 respectively, so as to be pivotable, as illustrated in FIG. 3. Hinge sets 15, 17 and 19, 21 are preferably of the ratchet type which, once set in position, will remain in the set position until moved.

Figure 4:
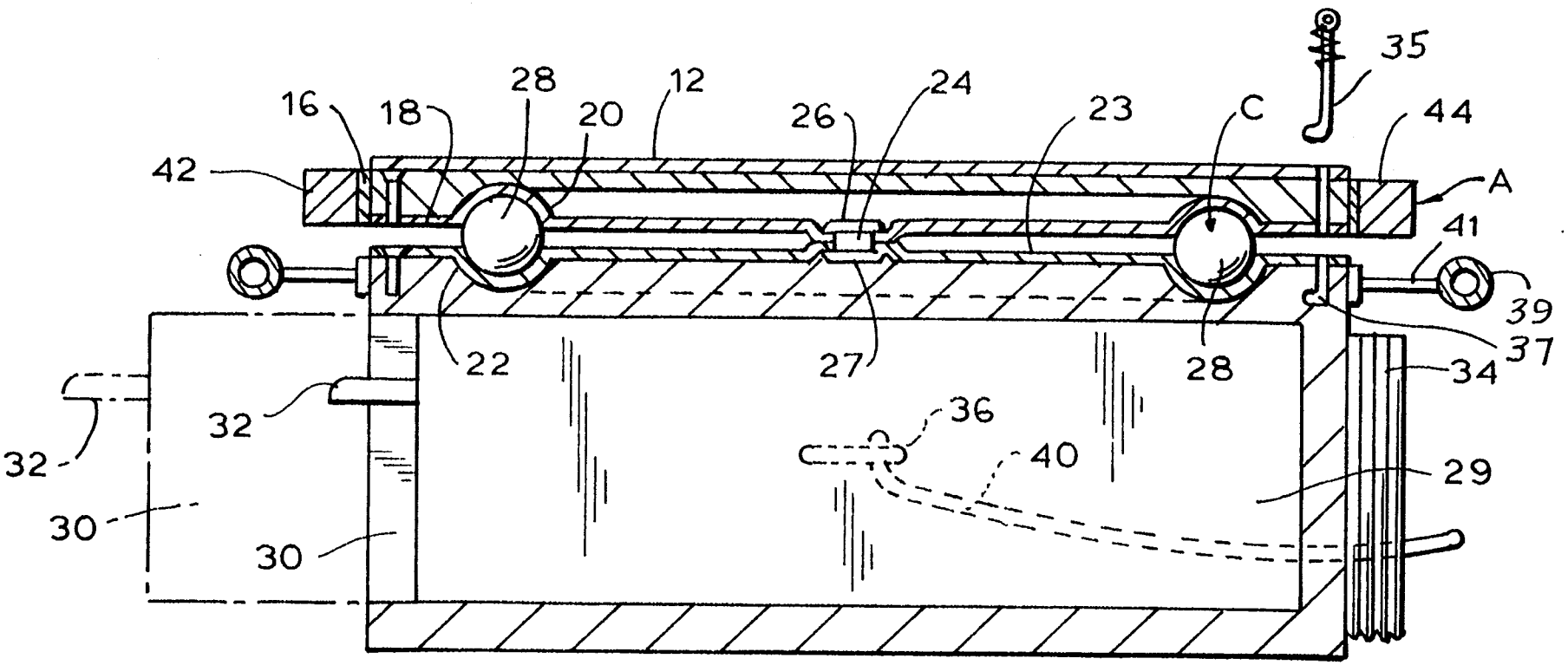
FIG. 4 is a cross sectional view of the chair taken along line 4—4 of FIG. 3.

As seen in FIG. 4, the top plate 18 of rotation mechanism C is affixed to the seat section frame 16 by any conventional means, such as screws or rivets. The lower surface of plate 18 has formed in it or attached to it the upper portion 20 of a circular ball bearing track. The diameter of the ball bearing track is relatively large, preferably over one half the length of the base, in order to provide maximum stability.

Figure 2:
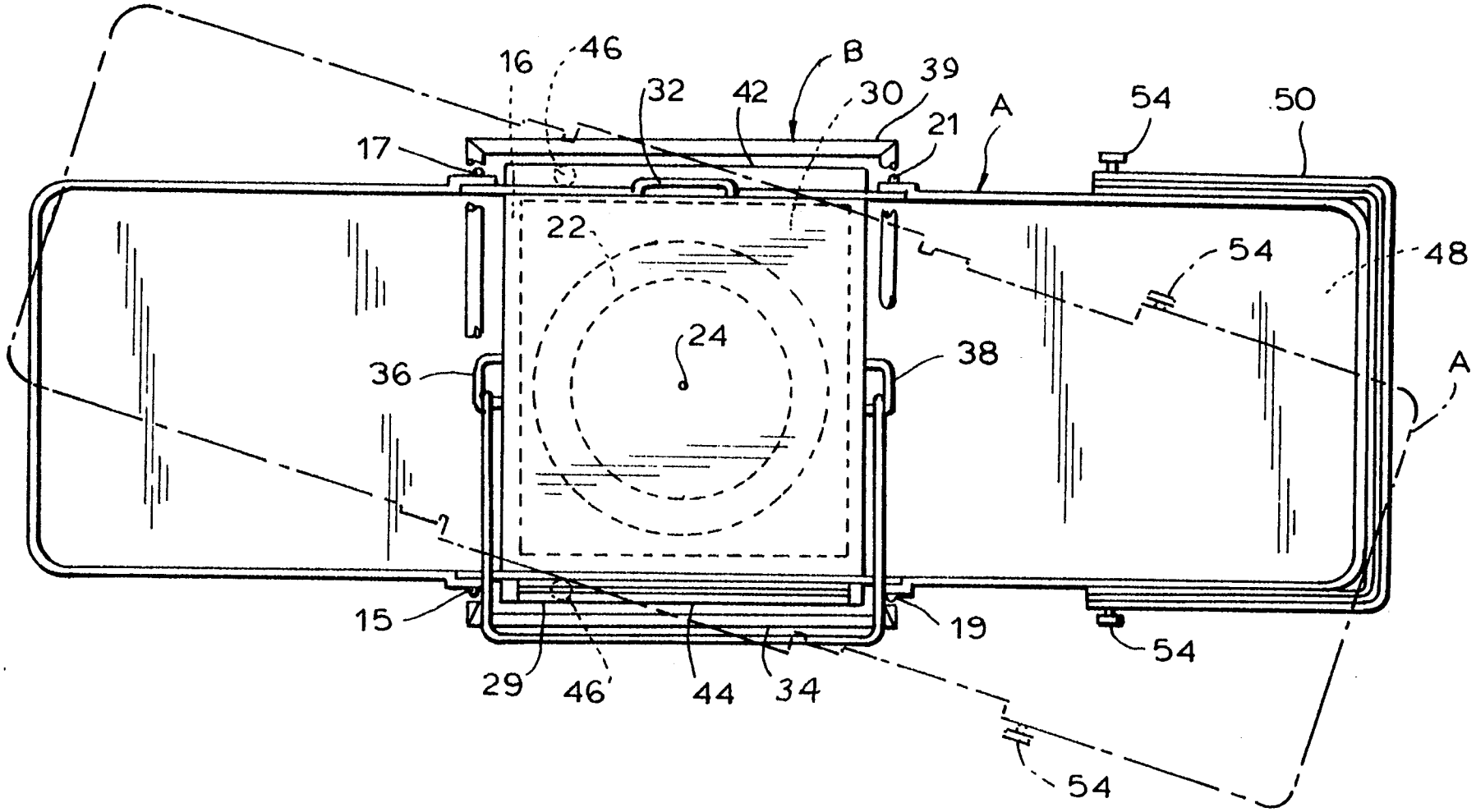
FIG. 2 is a bottom view of our chair.

The upper surface 23 of base B comprises a plate 23 which contains a corresponding sized circular track portion 22. A center pin 24 is provided. Pin 24 is aligned with pin receiving sockets 26, 27 in plates 18, 23, respectively located at the center of track. When ball bearings 28 are placed in track portion 22 and plates 18 and 23 properly aligned, pin 24 is received into sockets 26, 27 such that body support A can freely rotate on base B about an axis defined by center pin 24, as shown in FIG. 2.

Base B is a hollow heat insulated enclosure 29 the walls of which are structurally reinforced to support the necessary weight requirements for the chair. It is provided with a slideable insulated access drawer 30 with a handle 32. Enclosure 29 is heat insulated to keep food and beverage products cool in the hot weather. It is also preferably provided with a pouch 34 for carrying magazines or books. Pouch 34 is preferably made of a soft textile material such as canvas or elastic net.

To facilitate transport of the lounge, we have provided a pair of handles 36, 38 connected by a shoulder strap 40. When body support A is folded, the entire chair can be easily transported using one of the handles 36, 38 or by using shoulder strap 40.

Seat frame 16 is provided with a spring loaded pin 35. The top surface of enclosure 29 is provided with a pin receiving recess 37. When pin 35 is aligned with recess 37 by rotating frame 16 relative to base B, the pin may be depressed into the recess and turned to maintain it in position. The pin will remain within recess 37 to lock the body support portion against rotation relative to the base to further facilitate transport.

Enclosure 29 is preferably provided with a handrail 39. Rail 39 is mounted on a plurality of outstanding brackets 41 which extend from the side surfaces of the enclosure at spaced intervals such that rail 39 surrounds the enclosure at a level below the arm rests 42, 44. Rail 39 is preferably circular in cross-sectional configuration.

Rail 39 facilitates movement of the body support portion relative to the base B. It provides the user with a convenient means of gripping base B so that the body support portion can be rotated about center pin 24. This eliminates the necessity for the user to stand up in order to reposition the body support portion.

Attached to the sides of frame 16 are arm rests 42, 44. One or both of the arm rests 42, 44 may be provided with a recess 46 adapted to hold a beverage cup or can (not shown).

The head support portion 48 of section 14 is provided with an accordion type collapsible sun shield 50 similar in structure to a hood found on baby carriages. As best seen in FIG. 3, shield 50 includes of several "U" shaped support ribs 52. The ends of ribs 52 are pivotally connected together at each side of section 14 by a pin or bolt 54 which passes through holes proximate the ends of the ribs. Opaque sheet material 56 is stretched over the ribs. Sun shield 50 can be moved to any position between a fully retracted condition (shown in FIG. 1) and a fully expanded condition (shown in FIG. 3), in accordion-like fashion, by pivoting ribs 52 about pins 54.

Although the chair of the present invention is described and illustrated in a manual embodiment, it should be appreciated that simple modifications, well within the skill of those in the art, can be employed to motorize rotation mechanism C such that body support A is driven to rotate the support relative to base B. In that case, a small electric motor may be installed within base B and appropriate gearing employed to apply relative rotational movement to plate 18. One system which may be used is described in U.S. Pat. No. 4,969,685 to Chihaya entitled "Powered Rotatary Seat". Preferably, the motor is battery or solar powered (such as the system disclosed in U.S. Pat. No. 4,379,588 to Speice entitled "Revolving Solar Lounger") and is of the reversible type, such that rotation in either direction may be achieved.

It should now be appreciated that the present invention relates to a rotatable suntanning chair which includes a multisectional articulated body support freely rotatably mounted on a heat insulated base enclosure. Through the use of a base with a box-like configuration and a relatively large diameter circular track ball bearing system, maximum stability and freedom of rotation are achieved. The chair is light weight and portable. The base is provided with handles and a strap to facilitate transport. Magazine storage, beverage cupholders and a collapsible sun shield are all featured. Motorized capability is possible with simple modification.

While only a single preferred embodiment of the present invention has been provided, it is obvious that many variations and modifications could be made thereto. It is intended to cover all of these variations and modifications which fall within the scope of our invention, as defined in the following claims:

We claim:

1. A rotatable lounge chair comprising a base, an articulated body support including a lower body section, a seat section and an upper body section and means for rotatably mounting said seat section of said body support on said base, said base comprising a box-like, heat insulated, hollow enclosure having a top surface, said rotatable mounting means comprising substantially circular ball bearing track means and a center guide pin operably interposed between said top surface of said base and said seat section of said body support, such that said body support is rotatable relative to said base about an axis defined by said center pin.

2. The chair of claim 1 wherein said base enclosure comprises an access drawer.

3. The chair of claim 1 wherein said base enclosure comprises a magazine storage recess.

4. The chair of claim 1 wherein said base enclosure comprises a transport strap.

5. The chair of claim 1 further comprising ratchet hinge means for operably connecting said lower body section to said seat section.

6. The chair of claim 1 further comprising rachet hinge means for operably connecting said upper body section to said seat section.

7. The chair of claim 1 wherein said seat section comprises a substantially rectangular frame.

8. The chair of claim 7 further comprising arm rests mounted on said seat frame.

9. The chair of claim 8 wherein one of said arm rests comprises a cup receiving recess.

10. The chair of claim 7 wherein said mounting means comprises a plate supporting said seat section frame and said track means comprises a lower track section and an upper track section, said lower track section being affixed on said top surface and said upper track section being affixed to said plate.

11. The chair of claim 10 further comprising center pin receiving means in said plate.

12. The chair of claim 1 wherein said upper body section comprises a head support portion and means for shielding said head support portion from the sun.

13. The chair of claim 12 wherein said shielding means comprises an accordion-like collapsible hood.

14. The chair of claim 13 wherein said hood comprises a sheet of flexible material, a plurality of relatively rigid substantially "U" shaped ribs supporting said sheet and having ends and means for pivotably mounting said ends of said ribs on said upper body section such that said hood is moveable relative to said head support portion between a collapsed position and an expanded position.

15. The chair of claim 1 further comprising means provided on said base for gripping said base such that said body support can be rotated relative to said base.

16. The chair of claim 15 wherein said gripping means comprises a handrail.

17. The chair of claim 1 further comprising means for locking said body support against rotation relative to said base.

18. The chair of claim 17 wherein said locking means comprises a pin moveably mounted on said body support and a pin receiving recess on said base.

* * * * *